US008216042B2

(12) United States Patent
Crawford, Jr. et al.

(10) Patent No.: US 8,216,042 B2
(45) Date of Patent: Jul. 10, 2012

(54) METHOD FOR CARD GAME BETTING BASED ON BURN CARDS

(76) Inventors: Kenneth Paul Crawford, Jr., Galloway, NJ (US); Panagioti Tountas, Atlantic City, NJ (US)

( * ) Notice: Subject to any disclaimer, the term of this patent is extended or adjusted under 35 U.S.C. 154(b) by 513 days.

(21) Appl. No.: 12/372,459

(22) Filed: Feb. 17, 2009

(65) Prior Publication Data

US 2010/0210334 A1 Aug. 19, 2010

(51) Int. Cl.
*A63F 9/24* (2006.01)

(52) U.S. Cl. ..... 463/13; 273/292

(58) Field of Classification Search ..... 463/10–13, 463/22; 273/274, 292, 293
See application file for complete search history.

(56) References Cited

U.S. PATENT DOCUMENTS

| | | | | |
|---|---|---|---|---|
| 5,632,485 | A | 5/1997 | Woodland et al. | |
| 5,636,843 | A | 6/1997 | Roberts | |
| 5,660,393 | A | 8/1997 | Dreger | |
| 5,707,285 | A | 1/1998 | Place et al. | |
| 5,713,574 | A | 2/1998 | Hughes | |
| 5,839,730 | A | 11/1998 | Pike | |
| 5,851,011 | A * | 12/1998 | Lott | 273/292 |
| 5,868,392 | A | 2/1999 | Kraft | |
| 6,227,969 | B1 | 5/2001 | Yoseloff | |
| 6,336,635 | B1 | 1/2002 | Baer | |
| 6,446,972 | B1 | 9/2002 | Brunelle | |
| 6,457,715 | B1 * | 10/2002 | Friedman | 273/274 |
| 6,692,003 | B2 | 2/2004 | Potter et al. | |
| 7,066,465 | B2 | 6/2006 | Daines | |
| 7,086,943 | B2 | 8/2006 | Mugnolo et al. | |
| 7,222,854 | B2 | 5/2007 | Sorge | |
| 7,222,855 | B2 | 5/2007 | Sorge | |
| 7,419,162 | B2 | 9/2008 | Lancaster et al. | |
| 7,462,102 | B1 | 12/2008 | Mendola et al. | |
| 2002/0036382 | A1 | 3/2002 | Brunelle | |
| 2003/0207706 | A1 | 11/2003 | Potter et al. | |
| 2006/0186598 | A1 | 8/2006 | Coussa | |
| 2006/0284376 | A1 | 12/2006 | Snow | |
| 2007/0262526 | A1 | 11/2007 | Patterson | |
| 2008/0007003 | A1 | 1/2008 | Davis et al. | |
| 2008/0188279 | A1 | 8/2008 | Seelig et al. | |

OTHER PUBLICATIONS http://www.casino1x2.com/help/rules/21burn.jsp 21 Burn Blackjack is an exciting multi-hand Blackjack that allows you to play up to 3 simultaneous hands with a BURN card option. You are dealt a face down burn card in.

(Continued)

*Primary Examiner* — Brook Kebede
(74) *Attorney, Agent, or Firm* — Russ Weinzimmer; Russ Weinzimmer & Associates PC

(57) ABSTRACT

A method of poker side betting based on burn cards is disclosed. The method enhances enjoyment of a poker game and increases house revenue, without slowing or detracting from the game itself. Before a poker round is dealt, players make bets predicting the identity of a burn card poker hand that will be produced by combining the burn cards of the poker round. After the round is played, the burn cards are revealed. Winnings are distributed for all bets that meet specified winning requirements. Bets can be placed into a side pot to be distributed among winners, or placed directly against the house according to house-established odds. In preferred embodiments, bets are made electronically via touch screens and locked before play begins, the burn cards are electronically scanned after play of the round and displayed on the touch screens, and winnings are distributed electronically.

28 Claims, 6 Drawing Sheets

OTHER PUBLICATIONS http://nngrvgmxqitvjo.blogspot.com/2006/09/bonus-whoringbelonging-to-raise-burn.html Bonus Whoring Belonging to Raise Burn Card.

http://www.burnpoker.com/burn-the-biffel This game is pretty interesting because players who think they have the hand often end up losing by the final card. It is played similar to Iron Cross.

* cited by examiner

METHOD FOR CARD GAME BETTING BASED ON BURN CARDS

FIELD OF THE INVENTION

The invention generally relates to poker card games, and more specifically to side bets in poker.

BACKGROUND OF THE INVENTION

Poker is a well known card-based betting game. Poker games sometimes include side bet options, wherein the players can bet on the likelihood of certain occurrences happening during the course of normal play. These side bets are independent of the main betting, but are often related to the cards that are played. Side bets are popular because of the profit they can generate for the house, and the added entertainment value they can provide for players.

There are various methods for making poker side bets known in the prior art. Side bets that are related to the cards used for the main betting are popular. However, they are somewhat limited in the added interest and entertainment they can generate, because they depend on the cards in play, which are already under scrutiny. Other methods for side betting require dealing of additional cards, which can slow down and distract from the main play. Still other types of side bets are unrelated to poker hands, or to playing cards in general. For example, in some prior art methods a side bet can be placed predicting which player will win a round of poker. However, these side bets either lack sophistication and variety, and therefore provide only limited interest, or they require a player to learn sophisticated rules unrelated to poker, and therefore require an unrealistic investment of time and effort on the part of the player.

One general aspect of the present invention is a method of side betting in a poker game that includes generation of burn cards. The method includes placing of a side bet by a player, the side bet being based on a prediction of a burn card poker hand, playing of a round of poker, including a dealer dealing a plurality of burn cards so as to produce the burn card poker hand, revealing the burn card poker hand, and awarding burn card winnings to the player if the prediction of the burn card poker hand meets a specified winning requirement.

In preferred embodiments, if the playing of the round of poker terminates before a complete burn card poker hand has been produced, the method further includes the dealer dealing additional cards in a manner simulating continued play of the round of poker until a complete burn card poker hand has been produced.

In some preferred embodiments the prediction of the burn card poker hand can be one of a royal flush, a straight flush, four of a kind, a full house, a flush, a straight, three of a kind, two pair, one pair, and a high card. In other preferred embodiments the prediction of the burn card poker hand can include a prediction of the suit of a card included in the burn card poker hand, and/or a numerical value of a card included in the burn card poker hand.

In various preferred embodiments, the side bet is placed into a side pot, the contents of which are divided, after playing of the round of poker, among all players who placed side bets based upon predictions that met a specified winning requirement. And in certain preferred embodiments the side bet is placed against a house represented by the dealer, and the burn card winnings are awarded according to odds predetermined by the house.

Another general aspect of the present invention is a method of side betting in a poker game that includes a dealer representing a house, and generation of burn cards. The method includes accepting entry of a side bet by a player, an electronic device being used by the player to enter the side bet into a computer, the side bet being based upon a prediction of a burn card poker hand, playing of a round of poker, including the dealer dealing a plurality of burn cards so as to produce the burn card poker hand, the dealer revealing the burn card poker hand, the computer awarding burn card winnings to the player if the prediction of the burn card poker hand meets a specified winning requirement, and the computer awarding the side bet to the house if the prediction of the burn card poker hand does not meet any specified winning requirement.

In some preferred embodiments, the prediction of the burn card poker hand can be one of a royal flush, a straight flush, four of a kind, a full house, a flush, a straight, three of a kind, two pair, one pair, and a high card. In other preferred embodiments, the prediction of the burn card poker hand can include a prediction of the suit of a card included in the burn card poker hand, and/or a numerical value of a card included in the burn card poker hand.

In preferred embodiments, the electronic device used to place the side bet includes a touch screen accessible to the player. In various preferred embodiments the method further includes the dealer causing the computer to electronically saving and locking all side bets before the playing of the round of poker. And in certain preferred embodiments if the playing of the round of poker terminates before a complete burn card poker hand has been produced, the house dealer deals additional cards in a manner simulating continued play of the round of round of poker until a complete burn card poker hand has been produced.

In some preferred embodiments, the side bet is placed into a virtual side pot, and the computer awards the burn card winnings by dividing the contents of the virtual side pot between players who placed side bets based on predictions of the burn card poker hand that met specified winning requirements. And in other preferred embodiments the side bet is placed against the house, and the burn card winnings are awarded according to odds pre-established by the house.

In preferred embodiments, the house dealer revealing the burn card poker hand includes the house dealer electronically scanning the identities of the burn cards into the computer. And in some of these preferred embodiments the house dealer revealing the burn card poker hand includes displaying of the burn card poker hand on the electronic device.

Yet another general aspect of the present invention is a method of enhancing enjoyment of a poker game that includes generation of burn cards. The method includes playing of a round of poker, including a dealer dealing a plurality of burn cards so as to produce a burn card poker hand, revealing the burn card poker hand, and awarding winnings to at least one player if the burn card poker hand meets a specified winning requirement.

In preferred embodiments, if the playing of the round of poker terminates before a complete burn card poker hand has been produced, the method further includes the dealer dealing additional cards in a manner simulating continued play of the round of poker until a complete burn card poker hand has been produced. And in various preferred embodiments the specified winning requirement is a requirement that the burn card poker hand be a specific poker hand.

SUMMARY OF THE INVENTION

A method of side-betting in poker is claimed that increases the number of cards in play, without requiring additional cards to be dealt, by allowing betting on poker hands formed from "burn cards," which are cards dealt from the deck and discarded ("burned"), so that they are not used by the players during play of a round of poker. The method thereby expands the number of cards that draw interest from the players, enhancing the enjoyment of a poker game, and increasing house revenues, without significantly slowing down or distracting from the main play.

Before each round of poker is dealt, participating players make burn hand bets based on predictions of the identity of the poker hand that will be produced by the burn cards of the poker hand. After the round is played, the burn cards are revealed, and winnings are collected by any players who made predictions that meet specified winning requirements. In some embodiments, the burn hand bets are placed into a side pot, and the side pot is shared equally among any winners, or is awarded to the house if there are no winners. In other embodiments, each burn hand bet is placed against the house, and winnings are paid by the house to successful betters according to predetermined odds. In preferred embodiments, if the round is not played to completion, the dealer deals additional cards in the same order as if the round had been completed, so as to generate a complete set of burn cards.

In further preferred embodiments, players use electronic touch screens to enter side bets into a computer, placing the bets either into a virtual side pot or against the house. In these embodiments, after the round of poker has been played, the burn cards are electronically scanned by the dealer so as to be visible on the touch screens, and the winnings are awarded and/or divided electronically. Use of the touch screens and the computer ensures that the side betting does not slow down, nor detract from, the main play of the poker game.

BRIEF DESCRIPTION OF THE DRAWINGS

The invention will be more fully understood by reference to the detailed description, in conjunction with the following figures, wherein.

DETAILED DESCRIPTION OF PREFERRED EMBODIMENTS

The present invention is a method of enhancing the play of poker by the awarding of burn bonus winnings according to burn card criteria that depend on a burn card poker hand formed by combining burn cards dealt during the play of a main poker hand. In various embodiments, the burn card criteria require that the burn card poker hand be a specific hand, such as a royal flush. For example, a fixed amount of winnings can be set aside in a jackpot, for example by a house that is hosing the poker game, and distributed among all players at a gaming table if a royal flush burn card poker hand is dealt at that table.

Figure 1:
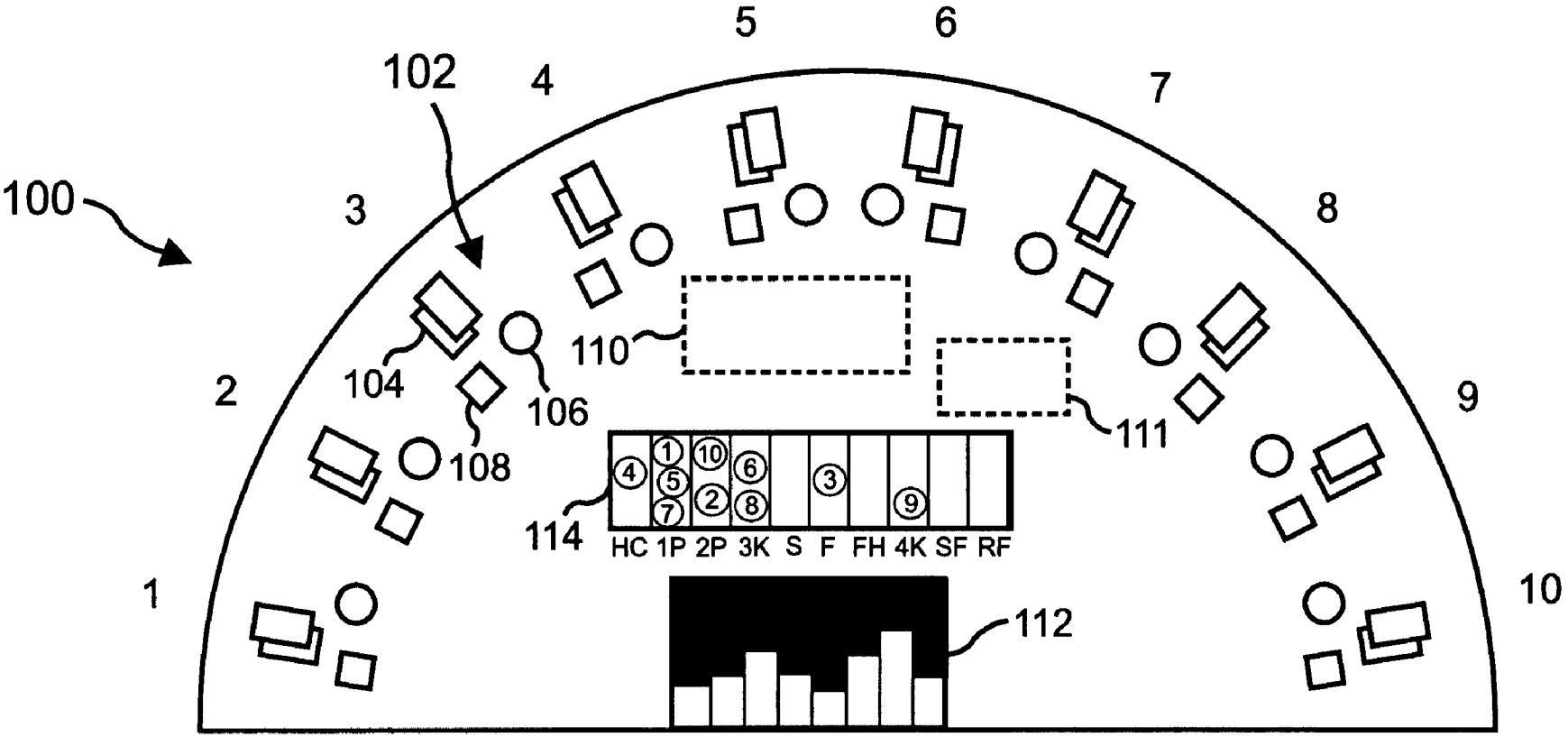
FIG. 1 is a top view of a poker table in a preferred embodiment that includes manual betting and result processing.

In many embodiments, the burn card criteria depend on poker players placing side bets based on predictions of specific burn card poker hands. FIG. 1 is a top view of a poker table 100 used in such a preferred embodiment of the invention. The table 100 is set for ten players. In this figure, each player's station 102 is shown with two cards of a main hand 104, a main bet area 106 that is related to the main hand, and a burn bet area 108 that is related to a burn hand that is produced by combining the burn cards that are dealt during the main hand. In the middle of the table 100 is a main hand card area 110, where cards used for the main hand are placed, such as the flop, the turn, and the river. Closer to the dealer is a burn card area 111, where all of the burn cards from the main hand are placed face down until the main hand is completed and the burn cards are revealed. A main pot area is located to the immediate left of the burn card area 111.

At the bottom of the table is a poker chips area 112. In between the main card area 110 and the poker chips area 112 is a dealer's burn bet monitoring area 114. The dealer can place player tokens 118 in appropriate burn hand areas 120 of the burn bet monitoring area 114, according to the kind of hand that each player has bet upon. As shown in the figure, player 1 has bet upon a one pair burn hand, player 2 has bet upon a two pair burn hand, player 3 has bet upon a flush burn hand, player 4 has bet upon a high card burn hand, player 5 has bet upon a one pair burn hand, player 6 has bet upon a three of a kind burn hand, and 7 has bet upon a one pair burn hand. Certain hand options are omitted if they cannot be created by the number of burn cards generated in the variety of poker being played. Furthermore, the house can restrict the hand options according to its preferences. For example, the house can decide that a side pot is put towards a jackpot which is only paid if a certain burn hand is produced, such as a royal flush.

The variety of poker being played can determine how many burn cards will make up the burn hand, and therefore the different kinds of burn hands that are possible. For example, in seven card stud, the burn hand can include four burn cards, while some other varieties of poker produce burn hands with five burn cards. Depending upon the number of burn cards, the burn hand may not be able to produce certain traditional kinds of poker hands.

Figure 2:
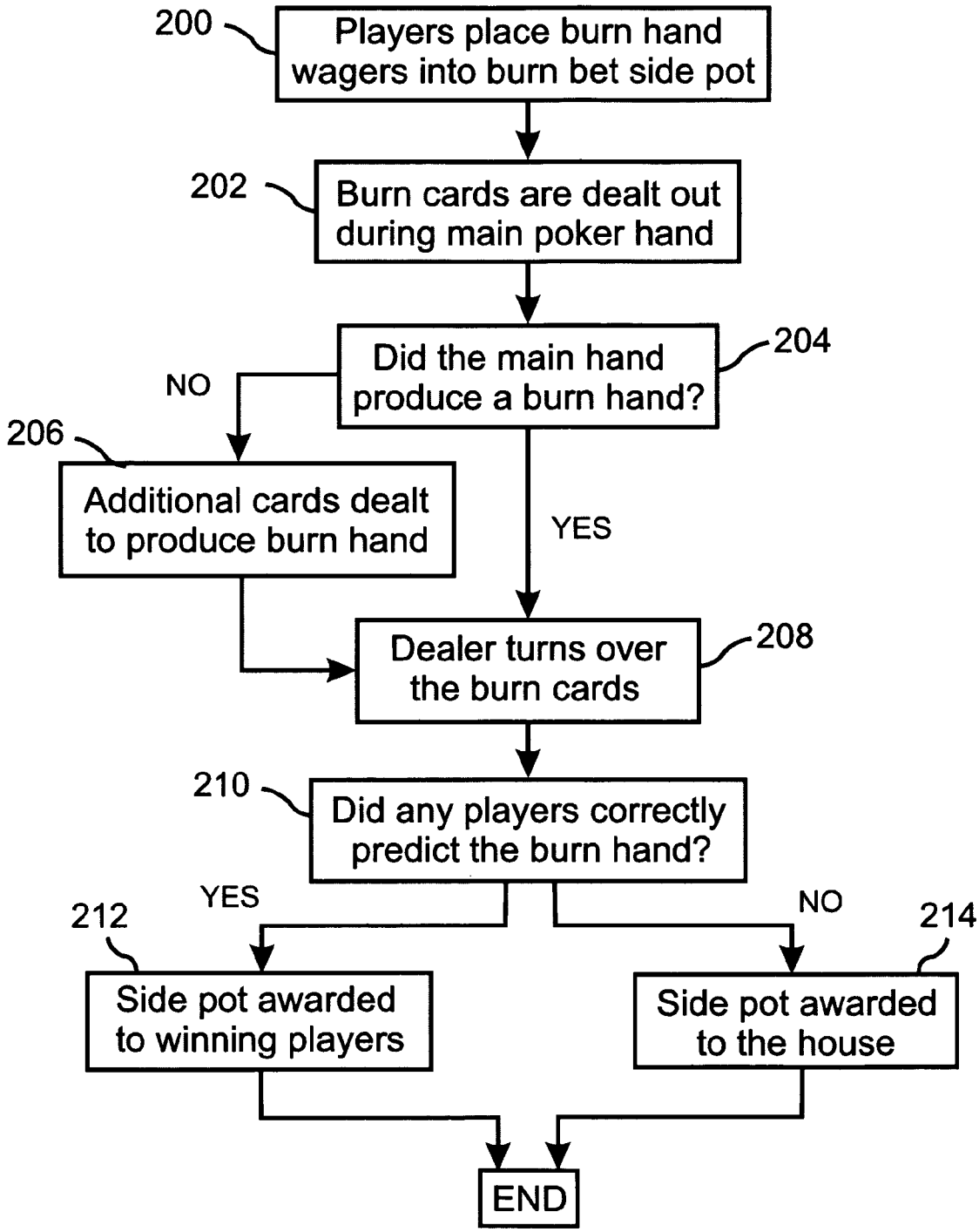
FIG. 2 is a flow diagram illustrating the preferred embodiment of FIG. 1.

FIG. 2 is a flow diagram illustrating the preferred embodiment of FIG. 1. First, all participating players place their bets into a burn bet side pot 200. In alternative embodiments, the players can place their bets individually against the house. Next, the main round is dealt, and the burn cards are dealt out during the dealing of the main round 202. If the main round is not completed 204, and therefore does not produce a complete burn hand, additional cards are dealt as if the main round were completed 206, so as to produce a complete burn hand. After all of the burn cards have been dealt, the dealer turns over the burn cards to reveal the burn hand 208. If any players correctly predicted the burn hand 210, those players share equally in the side pot 212. In alternative embodiments where players place individual bets against the house, winning players are paid according to predetermined house odds. If no players correctly predicted the burn hand, the side pot is awarded to the house 214. In embodiments where players place individual bets against the house, unsuccessful bets are awarded to the house and winning bets are rewarded according to odds determined by the house.

Figure 3:
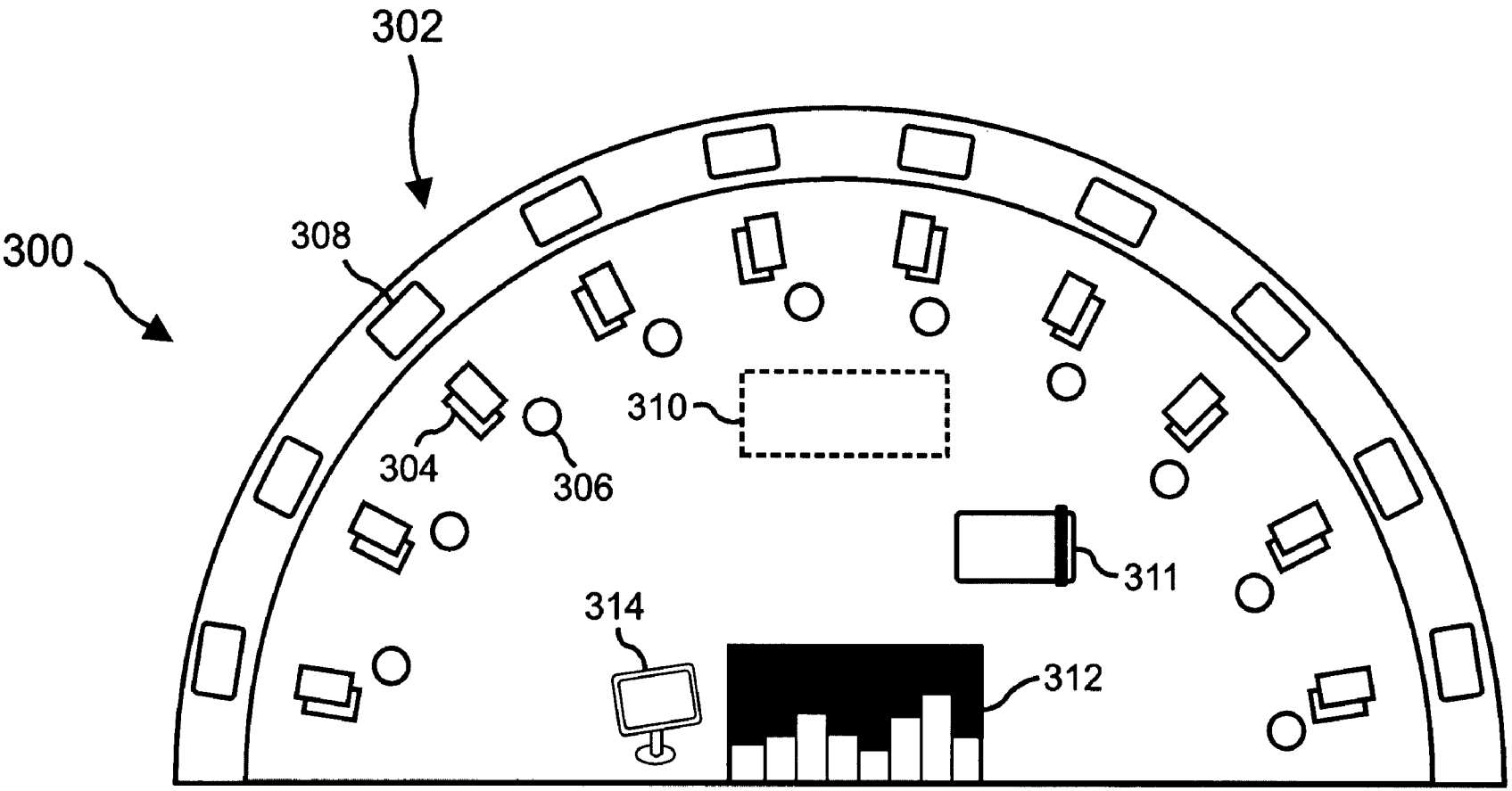
FIG. 3 is a top view of a poker table in a preferred embodiment that uses electronic touch screens and card scanning.

FIG. 3 is a top view of a poker table 300 in another preferred embodiment of the present invention. The table is set for ten players. In the figure, each player's station 302 is shown with two cards 304 of a main hand, a main bet area 306 is shown which relates to the main hand, and a touch screen 308 is provided at each player station that enables the player to make a burn bet based upon a prediction of a burn hand. As in FIG. 1, the burn hand is the hand produced by combining the burn cards that are dealt during the main round.

Once entered on the touch screens 308, the burn hand bets are stored and processed by a computer. In the middle of the table 300 is a main hand card area 310, where cards used for the main round are placed, such as the flop, the turn, and the river. Closer to the dealer is a burn card scanner window 311, where all of the burn cards from the main round are placed face down until the main round is completed, at which time the burn cards are scanned and revealed. A main pot area is to the immediate left of the burn card scanner window 311.

At the bottom of the table 300 is a poker chips area 312. Next to the poker chips area 312 is a dealer's burn betting monitor touch screen 314. Using the monitor touch screen 314, the dealer can lock in all of the players' burn bets before dealing out the cards for the main round.

The variety of poker being played determines how many burn cards will be included in the burn hand, and therefore the different kinds of burn hands that are possible. For example, in seven card stud, the burn hand will include four burn cards. Some other varieties of poker will produce a burn hand that includes five burn cards. Depending upon the number of burn cards, the burn hand may not be able to produce certain traditional kinds of poker hands.

Figure 4A:
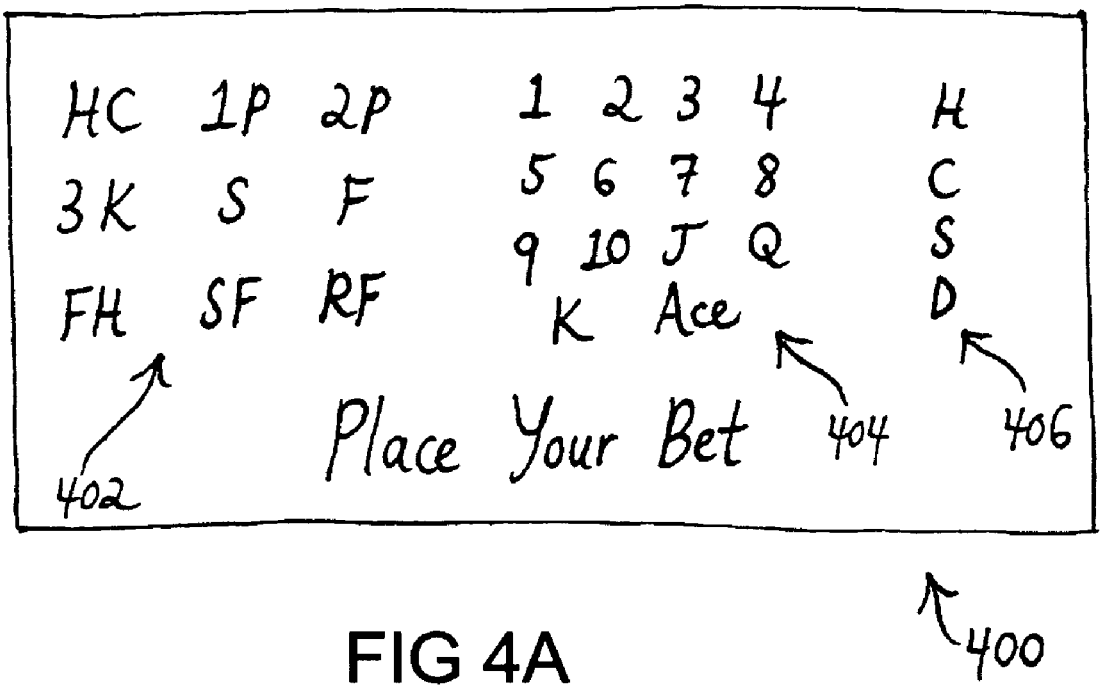
FIG. 4A illustrates a touch screen showing bet options, in accordance with the preferred embodiment of FIG. 3.

FIG. 4A illustrates a touch screen 400 showing bet options in accordance with the preferred embodiment of FIG. 3. In this figure, a player is presented with the various types of possible hands 402 that could be created by the burn cards. Certain hand options 402 are omitted if they cannot be created by the number of burn cards generated in the variety of poker being played. Furthermore, the house can restrict the hand options according to its preferences. For example, the house can decide to set up a tournament whereby winnings are only paid if a certain burn hand is produced, such as a royal flush. In FIG. 4A, the options are high card, one pair, two pair, three of a kind, straight, flush, full house, straight flush, and royal flush.

In the embodiment of FIG. 4A, there are also card numerical value bet options 404 and card suit bet options 406. In some embodiments of the invention, it is required that a player choose at least one numerical value option 404 related to the burn hand, and/or at least one suit option 406 related to the burn hand. For example, a casino house may require a player to choose the numerical value 404 and/or the suit 406 of a high card in a high card hand. In other embodiments a player is required to choose the numerical value 404 of the cards in a pair, the numerical value 404 of the high card in a straight, or the suit 406 of the cards in a flush hand. Other stipulations can be placed upon the burn bet as requirements, according to house preferences, or as options, so as to allow higher odds and therefore higher winning returns.

Figure 4B:
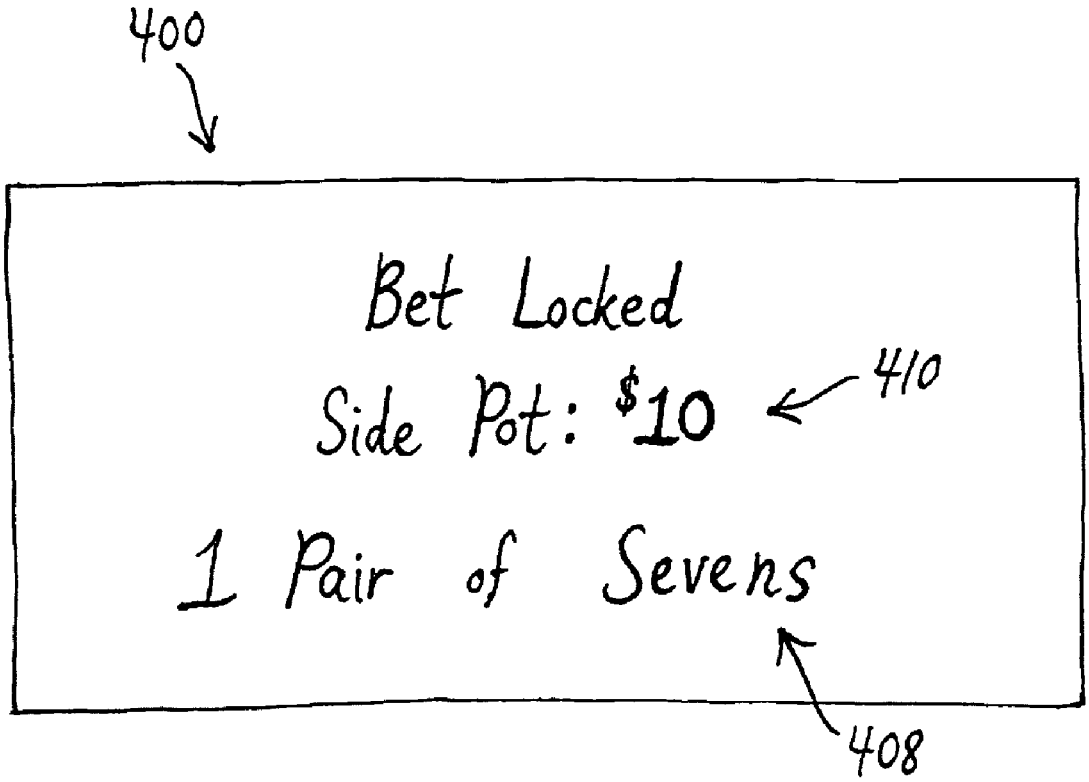
FIG. 4B illustrates a touch screen showing a locked bet, in accordance with the preferred embodiment of FIG. 3.

FIG. 4B illustrates a touch screen 400 showing a locked bet 408, in accordance with the preferred embodiment of FIG. 3. In this embodiment, the house dealer locks all players' bets before dealing the main round. The player using the screen shown in this FIG. 400 has placed a side bet 408 predicting a burn hand of a pair of sevens. In this example, the bet is included in a side pot that is worth ten dollars 410.

Figure 5A:
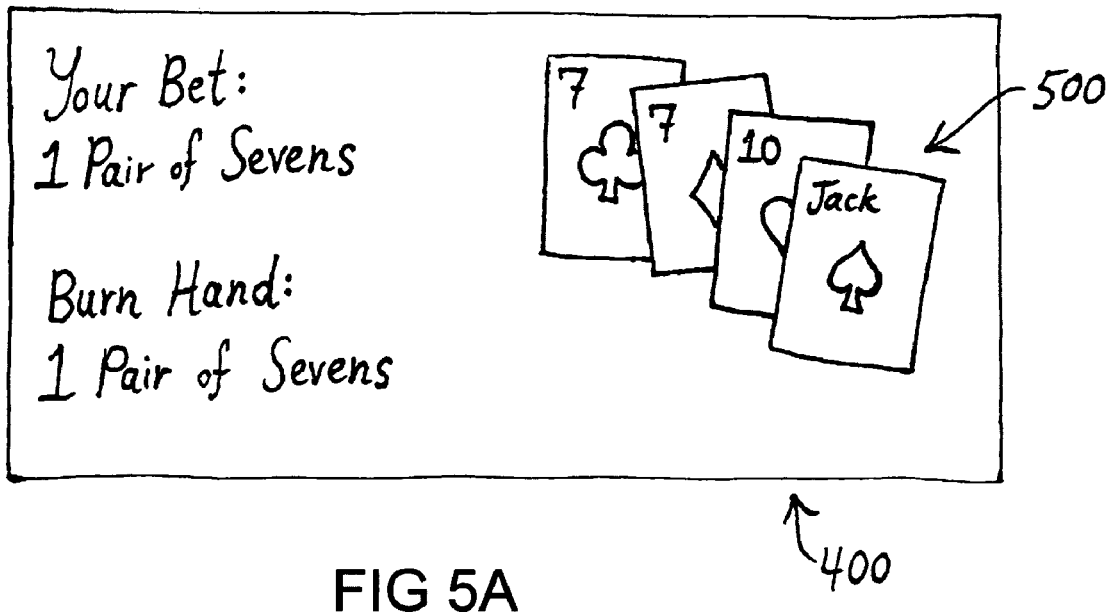
FIG. 5A illustrates a touch screen showing a burn card hand, in accordance with the preferred embodiment of FIG. 3.

FIG. 5A illustrates a touch screen 400 showing a burn hand 500 in accordance with the preferred embodiment of FIG. 3. After the main round is completed, the house dealer scans the burn cards, which are then displayed on all players' touch screens 500. In this example, the burn hand matches the hand predicted by the player.

Figure 5B:
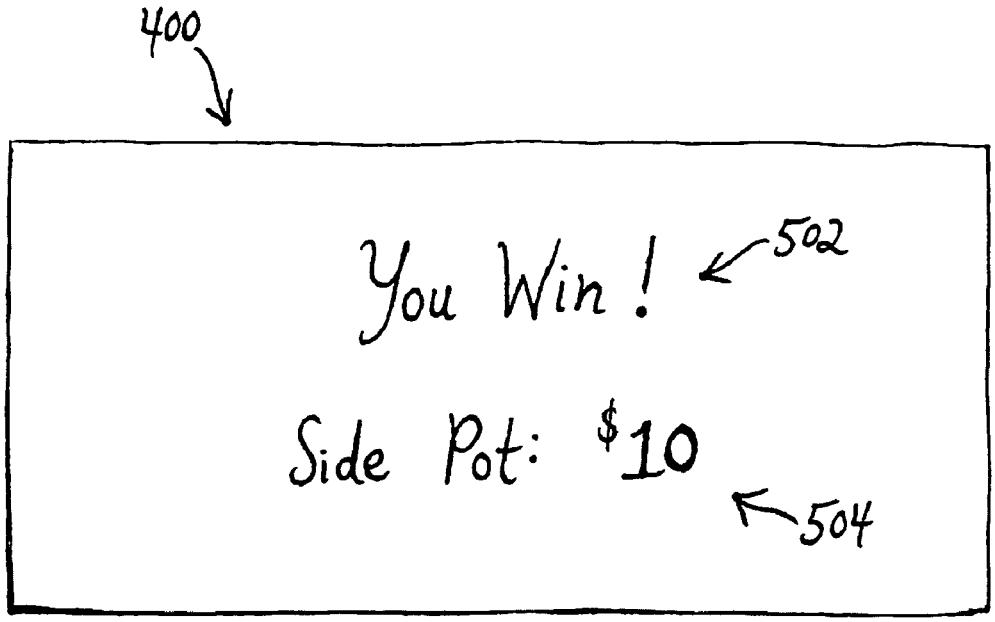
FIG. 5B illustrates a touch screen showing a side bet outcome, in accordance with the preferred embodiment of FIG. 5A.

FIG. 5B illustrates a touch screen 400 showing a side bet outcome 502, in accordance with the preferred embodiment of FIG. 5A. In this example, the side pot of ten dollars 504 is awarded to the player, who correctly bet on the burn hand 500 being a pair of sevens.

Figure 6:
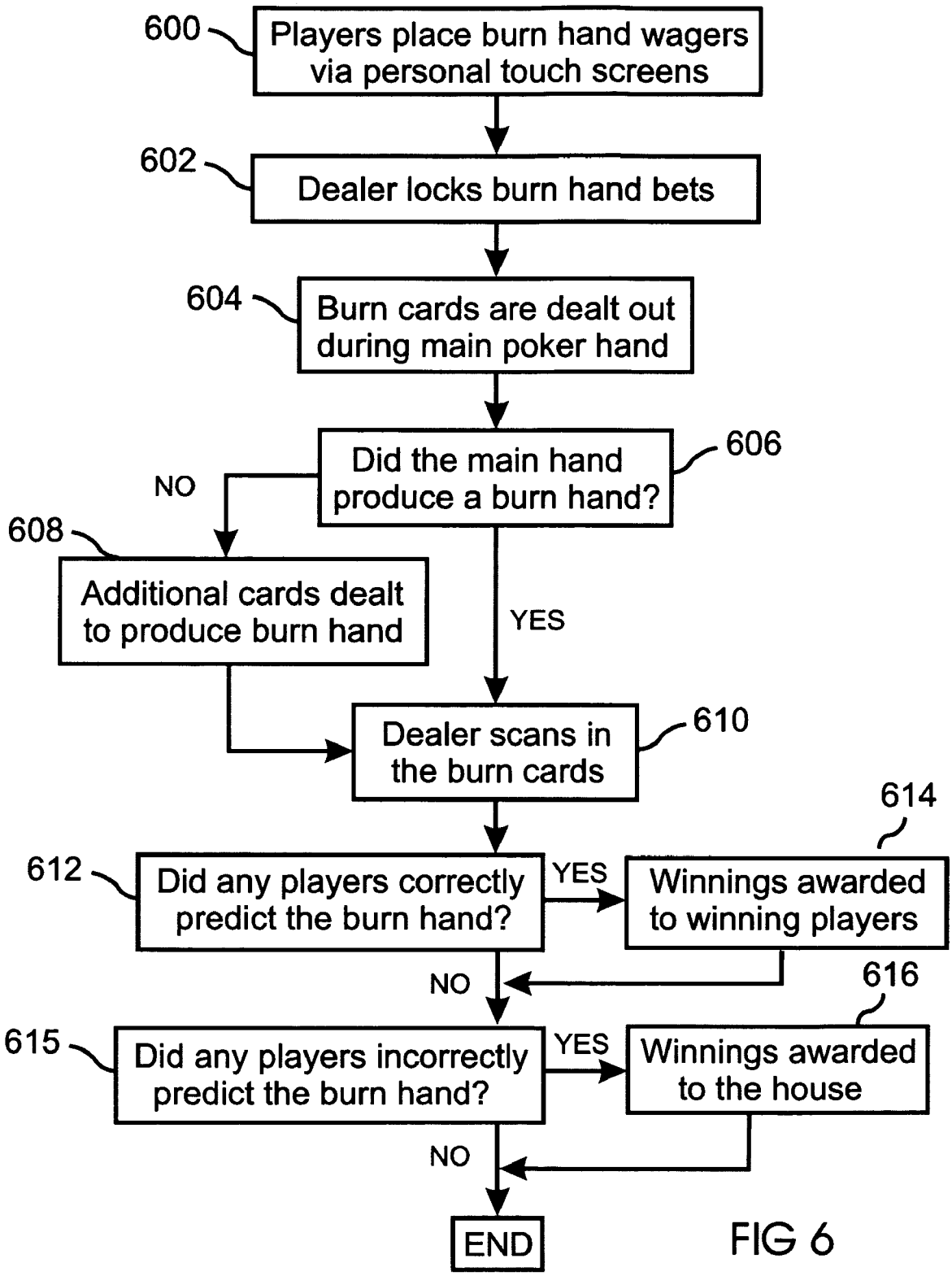
FIG. 6 is a flow diagram illustrating the preferred embodiment of FIG. 3.

FIG. 6 is a flow diagram illustrating the preferred embodiment of FIG. 3. First, all participating players place their bets via personal touch screens 600. The dealer then locks all players' burn hand bets 602, after which the main round is dealt and the burn cards are dealt during the dealing of the main round 604. If the main round is not completed 606, and therefore does not produce a complete burn hand, the dealer deals additional cards in the same order as if the round had been completed, so as to generate a complete set of burn cards 608. After all of the burn cards have been dealt, the dealer scans the burn cards to reveal the burn hand on each player's touch screen 610. If any players correctly predicted the burn hand 612, their individual winnings are paid according to predetermined house odds 614, or in alternative embodiments using a side pot, each winning player will share equally in the side pot. For all players who incorrectly predicted the burn hand 615, their bet is awarded to the house 616. If the bets were pooled into a side pot, the side pot can be electronically rewarded and divvied up as necessary, or the house can put the side pot into a jackpot, a tournament play, or the like.

Other modifications and implementations will occur to those skilled in the art without departing from the spirit and the scope of the invention as claimed. Accordingly, the above description is not intended to limit the invention except as indicated in the following claims.

What is claimed is:

1. A method of playing an enhanced poker game, the method comprising:

before starting a round of the enhanced poker game, accepting a bet from a player, wherein the bet is based on a prediction of a burn card poker hand;

while playing the round of the poker game, dealing a plurality of burn cards so as to produce the burn card poker hand;

revealing the burn card poker hand; and awarding burn card winnings to the player if the prediction of the burn card poker hand meets a specified winning requirement.

2. The method of claim 1, further comprising, if the playing of the round of the game terminates before a complete burn card poker hand has been dealt:

dealing additional cards in a manner simulating continued play of the round of the poker game until a complete burn card poker hand has been dealt.

3. The method of claim 1, wherein the prediction of the burn card poker hand is one of a royal flush, a straight flush, four of a kind, a full house, a flush, a straight, three of a kind, two pair, one pair, and a high card.

4. The method of claim 1, wherein the prediction of the burn card poker hand includes a prediction of at least one of:

the suit of a card included in the burn card poker hand; and a numerical value of a card included in the burn card poker hand.

5. The method of claim 1, wherein the bet is placed into a side pot, the contents of which are divided, after playing of the round of the poker game, among all players who placed bets based upon predictions that met the specified winning requirement.

6. The method of claim 1, wherein the bet is placed against a gambling house represented by a dealer, and the burn card winnings are awarded according to odds predetermined by the gambling house.

7. The method of claim 1, wherein the burn cards are physical cards.

8. The method of claim 1, wherein the burn cards are virtual cards.

9. A method of playing an enhanced poker game, the method comprising:

before playing a round of the enhanced poker game, accepting entry of a bet by a player into a computer, the bet being based upon a prediction of a burn card hand;

while playing the round of the poker card game, dealing a plurality of burn cards so as to produce the burn card hand;

revealing the burn card hand;

the computer awarding burn card winnings to the player if the prediction of the burn card hand meets a specified winning requirement; and the computer awarding the bet to a gambling house if the prediction of the burn card hand does not meet any specified winning requirement.

10. The method of claim 9, wherein the prediction of the burn card hand is one of a royal flush, a straight flush, four of a kind, a full house, a flush, a straight, three of a kind, two pair, one pair, and a high card.

11. The method of claim 9, wherein the prediction of the burn card includes a prediction of at least one of:

the suit of a card included in the burn card hand; and a numerical value of a card included in the burn card hand.

12. The method of claim 9, wherein the player uses an electronic device coupled to the computer to place the bet that includes a touch screen accessible to the player.

13. The method of claim 9, further comprising electronically saving and locking all side bets accepted by the computer before playing the round of poker.

14. The method of claim 9, further comprising, if the round of the poker game terminates before a complete burn card hand has been dealt:

dealing additional cards in a manner simulating continued play of the round of the poker game until a complete burn card hand has been dealt.

15. The method of claim 9 wherein the bet is placed into a virtual side pot, and the computer awards the burn card winnings by dividing the contents of the virtual side pot between players who placed bets based on predictions of the burn card hand that met specified winning requirements.

16. The method of claim 9, wherein the bet is placed against the gambling house, and the burn card winnings are awarded according to odds pre-established by the gambling house.

17. The method of claim 9, wherein the burn card hand is electronically scanned into the computer.

18. The method of claim 17, further comprising revealing the burn card hand by displaying the burn card hand on a player's electronic device.

19. The method of claim 9, wherein the burn cards are physical cards.

20. The method of claim 9, wherein the burn cards are virtual cards.

21. A method of playing an enhanced poker game, the method comprising:

during a round of the poker game, dealing a plurality of burn cards to produce a burn card hand;

revealing the burn card hand; and awarding winnings to at least one player if the burn card poker hand meets a specified winning requirement as predicted by the at least one player prior to playing the round of poker.

22. The method of claim 21, further comprising, if the round of the poker game terminates before a complete burn card poker hand has been produced:

dealing additional cards in a manner simulating continued play of the round of the poker game until a complete burn card poker hand has been produced.

23. The method of claim 21, wherein the specified winning requirement is a requirement that the burn card poker hand be a specific poker hand that is determined prior to playing the round of poker.

24. The method of claim 21, wherein the burn cards are physical cards.

25. The method of claim 21, wherein the burn cards are virtual cards.

26. A method of playing an enhanced poker game, the method comprising:

before playing a round of the enhanced poker game, accepting a bet of a player on a burn card hand via an electronic device;

after playing the round of the poker game, displaying the burn card hand on the electronic device; and displaying burn card winnings to the player on the electronic device if the player's prediction of the burn card hand meets a specified winning requirement.

27. The method of claim 26, wherein the burn cards are physical cards.

28. The method of claim 26, wherein the burn cards are virtual cards.

* * * * *